United States Patent [19]

DeCrane

[11] Patent Number: 4,676,284

[45] Date of Patent: Jun. 30, 1987

[54] BAG FILLING MACHINE WITH RELEASEABLE SUPPORTING ARMS

[76] Inventor: Charles E. DeCrane, 802 Janna St., West Monroe, La. 71291

[21] Appl. No.: 737,023

[22] Filed: May 22, 1985

[51] Int. Cl.[4] ..... B65B 3/16

[52] U.S. Cl. ..... 141/114; 141/314; 141/166; 53/570; 248/97

[58] Field of Search ..... 248/97, 99, 95, 100, 248/101; 53/570, 571, 384; 141/10, 114, 313–317, 385, 75, 76, 166; 220/1 T

[56] References Cited

U.S. PATENT DOCUMENTS

| | | | |
|---|---|---|---|
| 1,036,225 | 8/1912 | Hall | 141/314 |
| 1,118,669 | 11/1914 | McPherson | 141/314 |
| 1,132,600 | 3/1915 | Moore | 141/314 |
| 1,576,660 | 3/1926 | Lassen | 248/100 |
| 1,796,288 | 3/1931 | Hester | 141/314 |
| 3,215,173 | 11/1965 | Rutherford | 141/83 |
| 4,182,386 | 1/1980 | Alack | 141/83 |
| 4,519,426 | 5/1985 | Hardy | 141/5 |

FOREIGN PATENT DOCUMENTS

| | | | |
|---|---|---|---|
| 644624 | 10/1950 | United Kingdom | 141/313 |
| 645399 | 11/1950 | United Kingdom | 141/314 |

*Primary Examiner*—Stephen Marcus
*Assistant Examiner*—Ernest G. Cusick
*Attorney, Agent, or Firm*—Norvell E. Von Behren; Donna J. Thies

[57] ABSTRACT

A bag filling machine for use in holding a larger empty bag by a plurality of bag loops, the bag being filled while being held by the machine and then being released from the machine to be transported to a remote location is disclosed.

The machine comprises a plurality of downwardly and inwardly inclined members fixedly attached to the frame of the machine with the inclined members holding the empty bag by the plurality of bag loops usually used on an empty bag. A generally C-shaped hook is pivotably mounted on each inclined member and is moved from a holding position to a release position by a plurality of linkage rods connected to an activating mechanism. The inclined members and the C-shaped hooks co-act to permit the filled bag to release itself by gravity from the inclined members upon an activation of the C-shaped hooks by the activating mechanism. The activating mechanism may be a manual one such as a human being, a hydraulic cylinder, an air cylinder and an electric solenoid among other types.

17 Claims, 12 Drawing Figures

BAG FILLING MACHINE WITH RELEASEABLE SUPPORTING ARMS

BACKGROUND OF THE INVENTION

This invention relates generally to bag filling machines and more specifically to a new and improved bag filling machine which permits easy removal of a filled bag from the filling machine.

With the advent of large containers for the shipment of bulk materials from one location to another, there was introduced into this country approximately ten years ago large square woven polypropylene bags for this purpose. These bulk bags have a capacity ranging from twenty cubic feet up to seventy cubic feet and may vary in size from thirty-five inches wide by thirty-five inches long by twenty-three inches high up to the same width and length bag having a height of eighty-two inches unfilled.

The bags are constructed with bag loops on the top of the bag which are used for transporting the bags from one location to another and also for holding the bags while they are being filled in a filling machine. The bag loops are generally constructed of a strong web-like material which is sewn onto the upper corners of the square bag.

Prior art bag filling machines which hold these large bulky bags have encountered problems in removing the filled bag from the filling machine, since the filled bag may weigh as much as two-thousand pounds. The problem was directed to removing the heavy bag from the filling machine since a portion of the two-thousand pound weight would be applied to the bag loops resulting in difficulty in getting the bag loop from the device holding the bag in the machine. The bag loops would tend to hang upon the various rods or hooks used since many times the material being filled in the bag was a sticky material and the environment around the filling machine was one of a dust laden atmosphere containing the sticky material.

In the applicants drawing filed with this application and in particular FIGS. 1 and 2 of the drawing there is shown several of the prior art bag filling machines shown holding the large bulky bags. Further detail will be given hereinafter in the specification outlining the specific area of problems encountered with these devices.

SUMMARY OF THE INVENTION

In order to overcome the problems hereinbefore described and inherent in many of the prior art bag filling machines, there is provided by the applicants invention a new and novel improved bag filling machine which permits a filled bag to release itself by gravity from the bag filling machine at a predetermined time thereby alleviating prior problems of bag hang-up due to the heavy weight of the filled bag. The releasing of the bag is accomplished by providing a bag filling machine comprising a frame and having associated with the frame holding means for holding the empty bag prior to filling the bag and during the filling of the bag. The holding means in the preferred embodiment comprises a plurality of downwardly and inwardly inclined members which are fixed to the frame with these members holding the empty bag and the filled bag by the plurality of bag loops sewn into the top of the bag.

Release means are associated with the holding means and serve to release the filled bag from the holding means after the bag has been filled. The release means comprises in the preferred embodiment a generally C-shaped hook which is pivotably mounted on each holding means with the hook having a holding position and a release position. Whenever the bag loops are placed over the incline members, the C-shaped hook is positioned in the holding position. As the bag is filled, the holding means will hold the filled bag and should the bag slide on the inclined member, the C-shaped hook will restrain further movement of the bag.

Upon completion of the filling operation, the C-shaped hook release means pivotably mounted on each incline member will be activated by activating means to a release position thereby allowing the filled bag to slide by gravity off of the inclined members to a position where it may be self-standing and transported to a remote location by a fork-lift truck or by other means. The inclined members are pointed toward the center of the bag and the bag machine so the bag will settle in a perfectly vertical direction and the loads are all uniform on all the bag loops.

The activating means in the preferred embodiment would comprise in part an activating mechanism which would be pivotably connected to a plurality of linkage rods that are connected to the C-shaped hooks. The activating mechanism may comprise in the preferred embodiment a hydraulic cylinder, an air cylinder, an electric solenoid and may also be mechanically activated by a human being using his hand.

Accordingly it is an object and advantage of the invention to provide a new and improved bag filling machine which allows a large bulky filled bag to release itself from the bag filling machine by gravity upon activation of a release means associated with the bag machine.

Another object and advantage of the invention is to provide a new and improved bag filling machine which reduces release time from the filling machine due to sticking bags on the machine or due to the particular complicated construction of the bag filling machine.

A further object and advantage of the invention is to provide a simplified improved bag filling machine which may be constructed to allow a bag to be quickly positioned on the filling machine and to be equally quickly released from the filling machine thereby reducing wasted time in positioning and releasing the bag from the frame of the filling machine.

These and other objects and advantages of the invention will become apparent from a study of the drawings showing the invention in its preferred embodiment and from a study of the description of the preferred embodiment hereinafter described.

The subject bag filling machine positively positions the bag with its sidewalls in a parallel position thereby assuring the bag will fill out in a square configuration and be aligned on the center line of the machine.

DESCRIPTION OF THE PREFERRED EMBODIMENT

Figure 1:
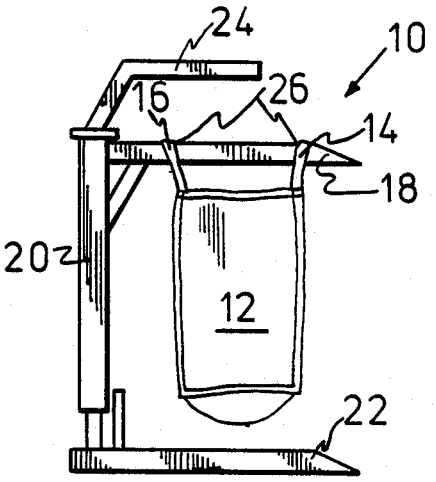
FIG-1 PRIOR ART
FIG. 1 is a side view of a prior art bag filling machine.
Figure 2:
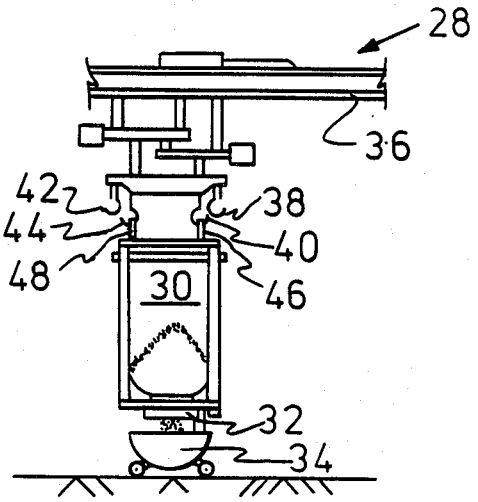
FIG-2 PRIOR ART
FIG. 2 is a side view of another prior art bag filling machine.

Referring now to the drawings in general and in particular to FIGS. 1 and 2 of the drawing there are shown prior art views of two types of the several types of prior art bag filling machines on the market today. FIG. 1 shows one type of prior art bag filling machine generally by the numeral 10 which is designed to hold a bag 12 having a plurality of bag loops 14 and 16 on a pair of arms 18. The arms 18 are supported from a vertical frame 20 which is moveable on a lower stand 22 to accomodate various sized bags. An upper frame holder 24 is used to carry the filling spout and dust control mechanism used in filling the bag 12. As has been before mentioned, due to the particular construction of the cantilevered arms 18 and positioning of the bag loops 14 and 16 on the arms, whenever the filled bag 12 is completely filled, it is difficult to release the bag loops 14 and 16 from the horizontal arms 18 due to the weight of the filled bag 12 and the stickiness of the material coming from the bag 12 which deposits itself on the arms 18 at the location numbered 26 making removal somewhat difficult.

Referring to FIG. 2 of the drawing there is shown another prior art bag filling machine generally by the numeral 28 which is used to hold a bag 30 having a bottom discharge chute 32 for discharge of the contents of the bag into a container 34. A frame 36 contains a plurality of hooks 38, 40, 42 and 44 which are used to hold the bag 30 in the filling and weighing machine until release of the hooks. The bag loops 46 and 48 must be removed from the hooks 38, 40, 42 and 44 by an operator resulting in lost time and sometimes difficulty in removing from the particular type of hook.

Figure 3:
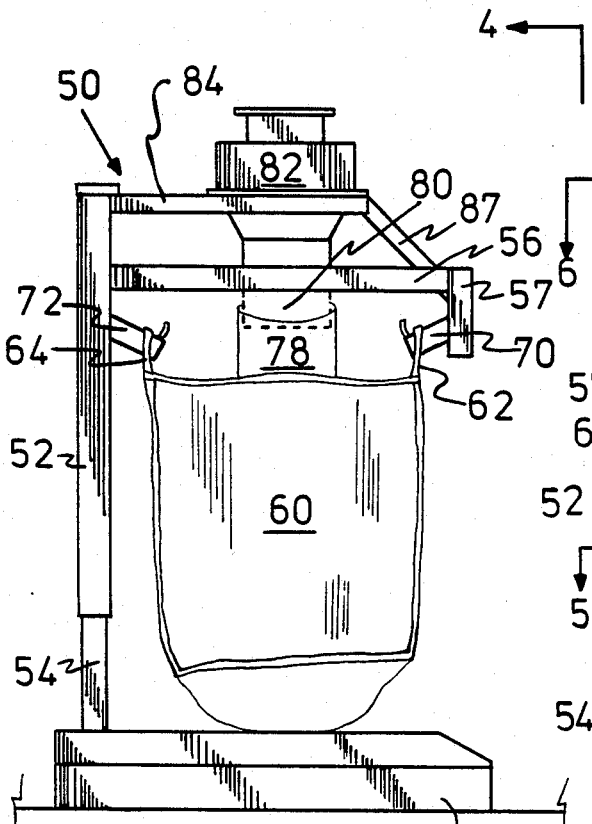
FIG. 3 is a side view of the applicants improved bag filling machine.
Figure 4:
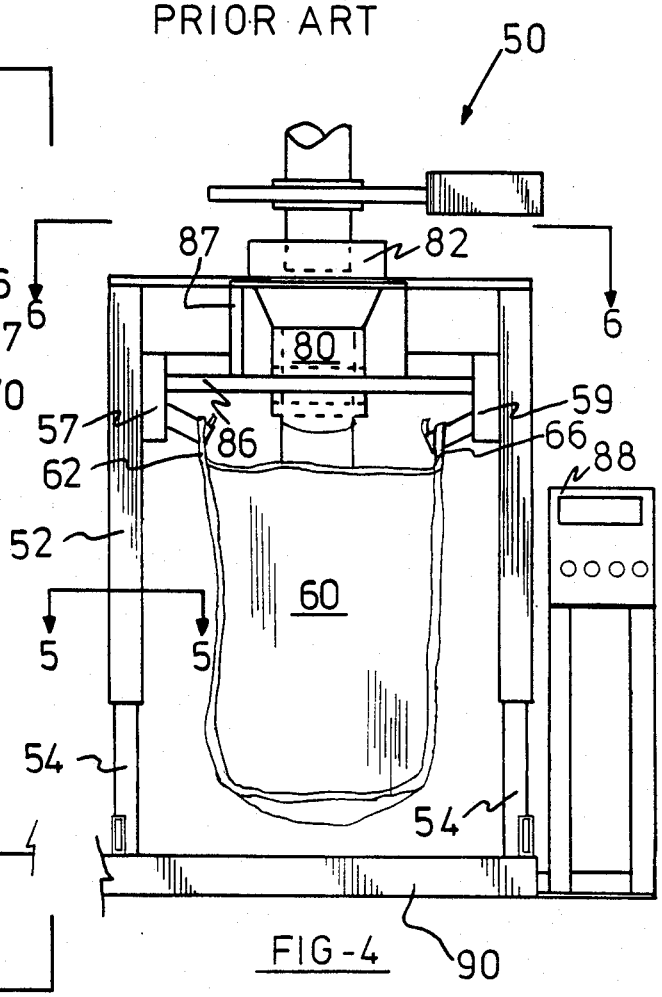
FIG. 4 is a front view, taken along line 4—4 of FIG. 3, showing the applicants improved bag filling machine.
Figure 6:
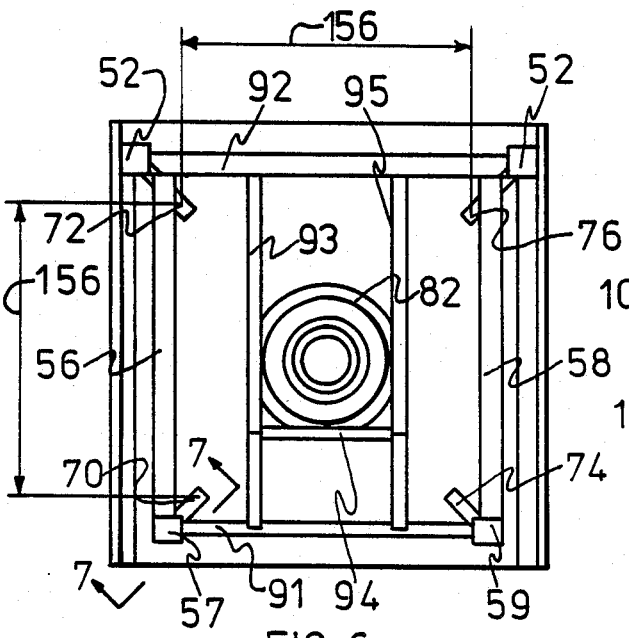
FIG. 6 is a top view, taken along line 6—6 of FIG. 4.

Referring now to FIGS. 3 and 4 of the drawing there is shown the applicants new and improved bag filling machine, generally by the numeral 50 which comprises a vertical frame 52 positioned over an inner vertical frame 54 fixedly attached to a load cell weight platform 90. A pair of arms 56 and 58 are fixedly attached to the vertical frame 52 and contain vertical tubular frames 57 and 59 which are fixedly attached to the arms 56 and 58. A pair of holding means 70 and 74 are welded to the frames 57 and 59. A pair of holding means 72 and 76 are welded to the vertical frames 52 as shown in FIGS. 3 and 6. The holding means 70, 74, 72 and 76 are used to hold the empty bag 60 on the bag filling machine by the plurality of bag loops 62 and 64 shown in FIG. 60 and by the opposite side bag loops 66 and 68 not shown in the drawing FIG. 3.

The upper neck 78 of the bag 60 would be positioned around a filling spout 80 connected to a filler 82 which would be held by a horizontal upper arm 84 for support of the filler mechanism along with the dust control hood and plenum used to minimize dust in the area of the bag filling machine. An inflating cuff would be used to seal the upper neck 78 of the bag on the filling spout 80 while filling the bag. The inflating cuff is not shown in FIG. 3 of the drawing for purposes of clarity. Various other connecting arms such as the connecting arms 86 and 87 are used to structurally support the cantilevered arms 56 and 58.

Figure 5:
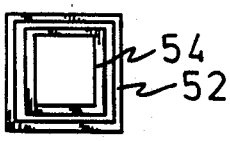
FIG. 5 is a cross-sectional view, taken along line 5—5 of FIG. 4, showing a portion of the frame of the applicants improved bag filling machine.

In FIG. 4 there is also shown the control station 88 which is connected to the load cell weighing platform 90 for precisely weighing the bag as it is filled by the filler mechanism 82. The drawing FIG. 5, taken along line 5—5 of FIG. 4 shows how the vertical frames 52 are positioned around the lower stand 54 to allow the upper portion of the bag filling machine to be raised and lowered to accommodate the various size bags 60.

The design of the applicant's novel bag filling machine frame allows access from all four sides of the machine with three sides being obstruction free.

Referring now to FIG. 6 of the drawing there is shown a top view, taken along line 6—6 of FIG. 4 showing in greater detail the horizontal arms 56 and 58 connected to the various cross members 91 and 92 along with the cross members 93, 94, 95 all fixedly attached and welded together to form the supporting structure for the filler mechanism 82. In can also be seen in FIG. 6 how two of the holding means 70 and 74 are fixedly attached to the vertical downwardly extending members 57 and 59 and also how two of the holding means 72 and 76 are fixedly attached to the vertical frames 52.

Figure 7:
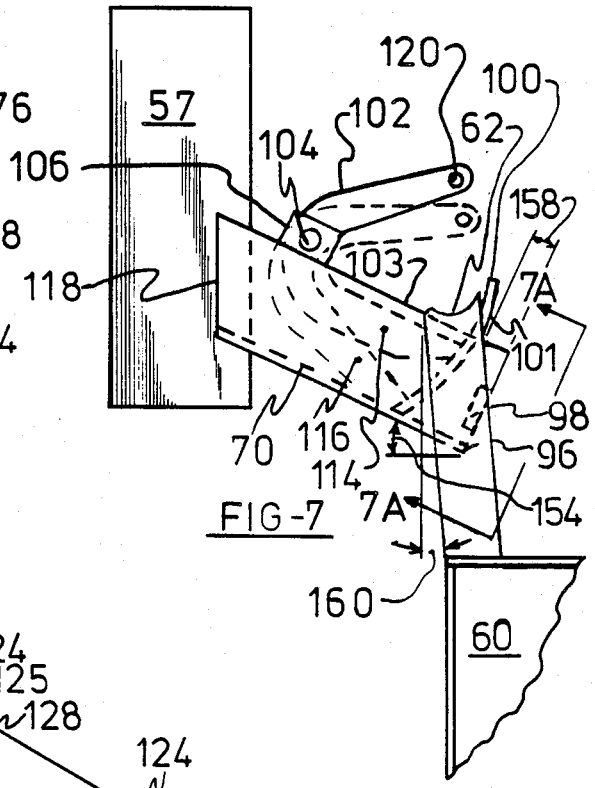
FIG. 7 is a side view, taken along line 7—7 of FIG. 6 showing the holding means and releasing means of the applicants invention.

Referring now to FIG. 7 of the drawing, there is shown a side view, taken along line 7—7 of FIG. 6 showing in greater detail the holding means and release means of the applicants invention. In FIG. 7 there will be shown one of the four similar holding means 70 with the other three holding means 72, 74 and 76 being similarly constructed. Holding means 70 and 72 as well as the holding means 74 and 76 comprise the U-shaped channel 96 which is positioned downwardly and inwardly inclined to form the inclined surface 103 upon which the bag loops 62, 64, 66 and 68 would be placed when the bag 60 is empty prior to its being filled. Due to the lightweight construction of the bag 60, friction of the bag loops 62, 64, 66 and 68 would hold the bag on the incline surface 103 where it would rest. In FIG. 7 of the drawing the release means used with the applicants invention would comprise a generally C-shaped hook 102 which would be pivotably mounted on a pin 104 with the hook 102 having a holding position 114 and a release position 116 shown in FIG. 7 of the drawing. The release means 100 would comprise a curved plate 101 which would be welded at 105 to the C-shaped hook as shown in FIG. 7B of the drawings. A plate 98 is welded to the end of the channel 96 to reinforce it as shown in FIG. 7A.

It can be seen in FIG. 7 how the holding position 114 of the C-shaped hook 102 would allow the plate 101 to be positioned upwardly to act to hold the bag loops 62, 64, 66 and 68 as the bag 60 was filled. Since the surface 103 is inclined downwardly, then as the bag is filled, the bag loops 62, 64, 66 and 68 would tend to slide down on the inclined surface 103 to the position shown in FIG. 7 to be held and restrained by the plate 101 in combination with the holding means 70. Whenever the C-shaped hook 102 was repositioned to the release position 116, then the filled bag would slide by gravity on the downwardly inclined surface 103 of the holding means 70, 72, 74 and 76 to rest on the load cell weight platform 90 shown in FIGS. 3 and 4, upon which the whole machine frame is mounted. The activation of the release means in the form of the C-shaped hook 102 is controlled by activating means which reposition the C-shaped hook 102 from the holding position 114 to the release position 116 at a predetermined time to permit the filled bag to release itself by gravity. The activating means will be described more fully hereinafter when referring to FIGS. 8, 9 and 10 of the drawing.

Figure 7A:
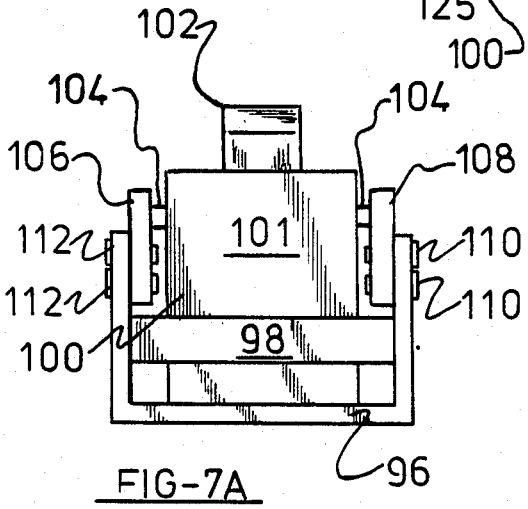
FIG. 7A is an end view, taken along line 7A—7A of FIG. 7 showing in more detail the holding means and releasing means of the applicants invention.
Figure 7B:
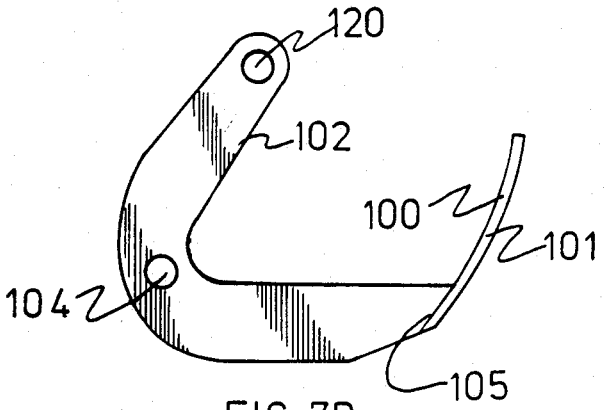
FIG. 7B is a side view of the release means comprising the generally C-shaped hook pivotably mounted on each holding means of the applicants invention.

Referring to FIG. 7A of the drawing there is shown an end view, taken along line 7A—7A of FIG. 7 showing in greater detail the release means 100 positioned within the channel 96 and welded to the C-shaped hook 102 as has been before mentioned. The C-shaped hook 102 is pivotably positioned on a pin 104 that is carried by a pair of plates 106 and 108 bolted to the channel 96 by a pair of bolts 110 and 112 through holes in the channel which are not shown in the drawing. In this manner the C-shaped hook 102 is able to be positioned from the holding position 114 to the release position 116 by means of a pin 120 connected to the activating means to be described hereinafter.

In FIG. 7B there is shown in greater detail a side view of the C-shaped hook 102 and showing how the plate 101 serving as the release means 100 would be welded at 105 to the C-shaped hook.

Figure 8:
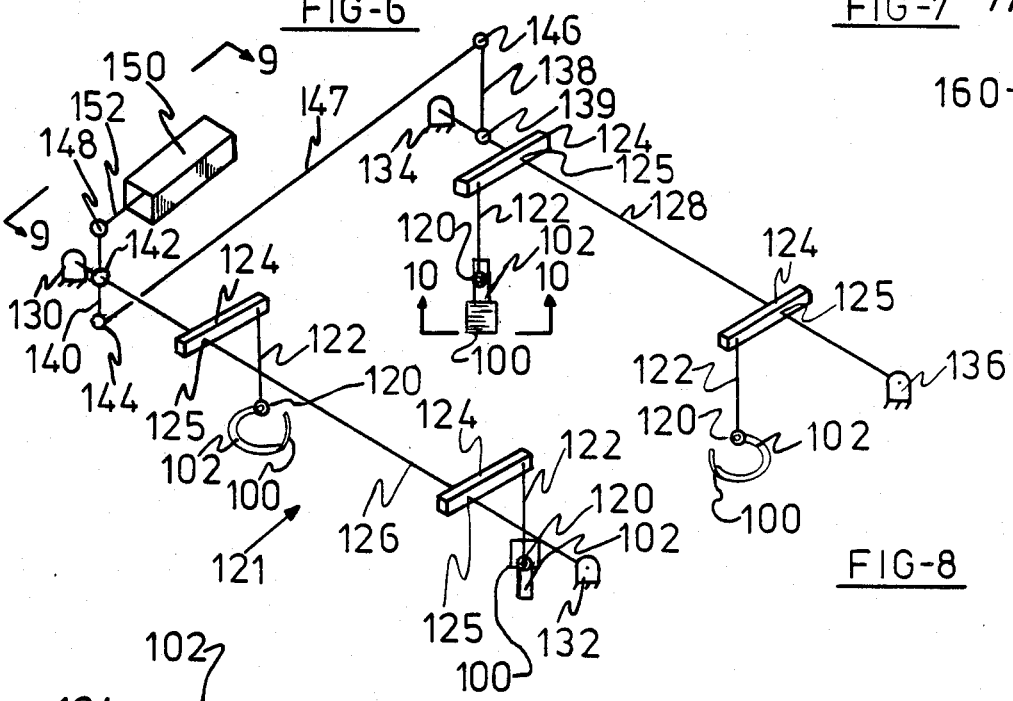
FIG. 8 is a simplified perspective view of the holding and releasing means showing how they are activated at a predetermined time to permit the filled bag to release itself by gravity from the holding means.

Referring now to FIG. 8 of the drawing, there is shown a simplified perspective view of the activating means shown generally by the numeral 121 which comprises in part a plurality of linkage rods pivotably mounted to the C-shaped hooks 102 and to each other to activate the hooks from the holding position 114 to the release position 116. It can be seen in FIG. 8 how a plurality of rods 122 are pivotably mounted to the pins 120 of the C-shaped hooks 102 and are connected to a plurality of arms 124 which are fixedly attached at 125 to a pair of linkage rods or horizontal shafts 126 and 128. The shafts 126 and 128 are carried by the bearings 130, 132, 134 and 136 which are positioned on the cantilevered arms 56 and 58 shown in FIG. 6 of the drawing.

A vertical arm 138 is fixedly attached to the shaft 128 and is pivotably connected to a shaft 147 by means of the pin 146 to rotate the shaft 128 as will be described hereinafter. The shaft 147 is also pivotably connected to the arm 140 by means of the pin 144 with the arm 140 fixedly attached to the shaft 126 by means of the fixed connection 142.

An activating mechanism 150 is pivotably connected by means of the shaft 152 to the arm 140 at the pivot connection 148 to activate the entire mechanism for activating the C-shaped hooks 102. The activating mechanism may comprise in part a hydraulic cylinder, an air cylinder, an electric solenoid and may also comprise a manual connection such as a human hand activating the shaft 152 to activate the entire mechanism.

It can be seen in FIG. 8 then how the activating mechanism such as a hydraulic cylinder 150 could be operated to cause the horizontal shafts 126 and 128 to rotate a predetermined amount to cause the arms 124 to raise and lower the C-shaped hook from a holding position to a release position. This would then allow the filled bag with the bag loops 62, 64, 66 and 68 to slide off of the holding means 70, 72, 74 and 76 along the inclined surfaces 103 of each of the holding means to drop to the load cell weight platform 90.

Figure 9:
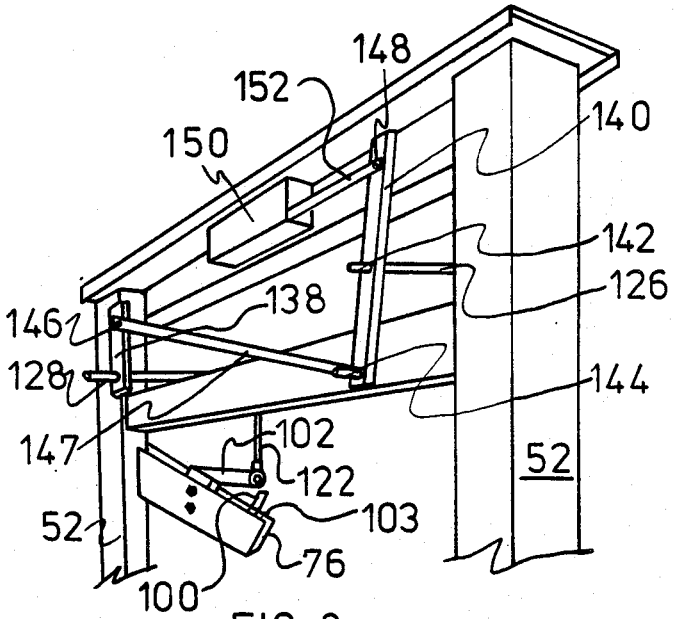
FIG. 9 is a perspective view, taken along line 9—9 of FIG. 8 showing in further detail the activating means for activating the release of the filled bag.
Figure 10:
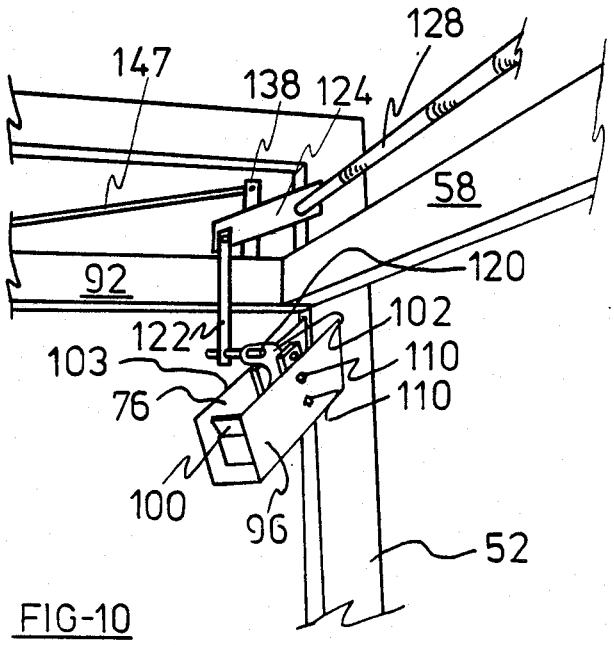
FIG. 10 is a side perspective view, taken along line 10—10 of FIG. 8 showing in further detail the positioning of the holding means and release means and also the mechanism for activating the release means to release the bag from the applicants bag filling machine.

Referring now to FIGS. 9 and 10 of the drawing there is shown in more detail how the various linkage rods shown in FIG. 8 are mounted on the respective frame members of the applicants bag filling machine and also showing in FIG. 9 how the activating means 150 would be positioned to be used to activate the various linkages to control the horizontal shafts 126 and 128 and in turn control the positioning of the C-shaped hooks 102 from the holding position 114 to the release position 116 as shown in FIG. 7.

From the foregoing it can be seen that there has been provided by the applicants invention a new and novel bag filling machine in the preferred embodiment having a plurality of downwardly and inwardly inclined members which are fixedly attached to the main frame of the applicants device for holding the bag on the inclined members in an empty position. Release means are provided which are associated with the downwardly and inwardly inclined members to release the bag at a predetermined time from the inclined members with the bag dropping by gravity from the bag filling machine thereby eliminating handling of the bag by an operator. Due to the predetermined downward and inwardly inclined position of the holding means 70, 72, 74 and 76 having the inclined surface 103 contained thereon, an automatic release of the bag by gravity is accomplished regardless of the sticky nature of the material contained in the bag and in the atmosphere surrounding the bag. The means for activating the release means may be a variety of activating means within the spirit and scope of the invention.

The slope of the holding means 70, 72, 74 and 76 and the inclined surface 103 of these members and the distance 156 between them should be such that a greater percent of the load of the bag is applied at an angle to prevent the weight of the bag from overcoming the holding means. It has been found by experimentation that the angle of the holding means 70, 72, 74 and 76 should preferably be approximately 25°. This angle is shown in FIG. 7 as the numeral 154. This angle may range from approximately 22° to 27° according to the type and size of bag used.

The spacing between the holding means 70, 72, 74 and 76 should be approximately 33" when using a standard 35"×35" square bag. The spacing between the holding means is shown in FIG. 6 as the numeral 156. This spacing may also vary between approximately 30" to 35" according to the type and size of bag used. If the spacing 156 between the holding means 70, 72, 74 and 76 is too large, then the bag loops 62, 64, 66 and 68 would tend to be lined up in a horizontal direction which would offset the use of the holding means. In other words, the bag loops 62, 64, 66 and 68 would tend to ride up on the release means 100 and may slip off the holding means. An angle of approximately 5° on the bag loops as shown in FIG. 7 as the numeral 160 would be preferable.

From experimentation it has been found advantageous to extend the holding means 70, 72, 74 and 76 beyond the release means 100 by approximately one-half to one inch as shown by the numeral 158 in FIG. 7. This allows the bag 60 to easily slip off of the inclined surface 103 without getting hung up on the edge of the holding means. As has been mentioned before, the holding means 70, 72, 74 and 76 all point to the center of the bag machine as shown in FIG. 6 to aid in properly holding the bag 60 in a true vertical position and to aid in properly aligning the bag prior to its being filled.

From the foregoing it can be seen that other changes may be made in the structure of the applicant's bag filling machine and in the arrangement of the various parts of the machine and positioning of those parts without departing from the spirit and scope of the invention. It is also noted that the preferred embodiment has been shown by way of illustration only and the applicant is not to be limited to the exact parts, arrangement of parts and structures described in the preferred embodiment and shown in the drawing within the spirit and scope of his invention.

Having described my invention, I claim:

1. A bag filling machine, for use in holding a large bag by a plurality of bag loops, the bag having a center and being filled while being held by the machine and then being released from the machine to be transported to a remote location, comprising:

(a) a frame;

(b) holding means, associated with the frame, for holding the bag prior to filling the bag and during the filling of the bag, the holding means further comprising a plurality of downwardly and inwardly inclined members being downwardly and inwardly inclined toward the center of the bag and fixedly attached to the frame, the inclined members holding the bag by the plurality of bag loops;

(c) release means, associated with the holding means, for releasing the filled bag from the holding means after the bag has been filled; the holding means and the release means coacting to permit the filled bag to release itself by gravity from the holding means upon an activation of the release means; and (d) activating means, associated with the release means, for activating the release means at a predetermined time to permit the filled bag to release itself by gravity from the holding means.

2. The bag filling machine as defined in claim 1 wherein the release means comprises a generally C-shaped hook pivotably mounted on each holding means, the hook having a holding position and a release position.

3. The bag filling machine as defined in claim 2 wherein the activating means comprises in part a plurality of linkage rods, pivotably mounted to the C-shaped hooks and to each other to activate the hooks from the holding position to the release position.

4. The bag filling machine as defined in claim 3 wherein the activating means comprises in part an activating mechanism pivotably connected to one of the linkage rods.

5. The bag filling machine as defined in claim 4 wherein the activating mechanism comprises an electric solenoid.

6. The bag filling machine as defined in claim 5 wherein the frame is adjustable vertically for handling different size bags.

7. The bag filling machine as defined in claim 4 wherein the activating mechanism comprises a hydraulic cylinder.

8. The bag filling machine as defined in claim 4 wherein the activating mechanism comprises an air cylinder.

9. The bag filling machine as defined in claim 4 wherein the activating mechanism comprises a human being.

10. In a bag filling machine for use in holding a large bag by a plurality of bag loops, the bag having a center, the bag filling machine comprising a frame which comprises in part a pair of arms fixedly attached to the frame, the improvement comprising:

(a) a plurality of downwardly and inwardly inclined members being downwardly and inwardly inclined toward the center of the bag and fixedly attached to the frame for holding a bag on the inclined members;

(b) release means, associated with the inclined members, for releasing the bag from the inclined members; and (c) means, associated with the release means, for activating the release means.

11. The improvement as defined in claim 10 wherein the release means comprises a generally C-shaped hook, pivotably mounted on each inclined member, the hook having a holding position and a release position.

12. The improvements as defined in claim 11 wherein the activating means comprises an activating mechanism pivotably connected to a plurality of linkage rods, a portion of the rods being pivotably connected to the C-shaped hooks.

13. The improvement as defined in claim 12 wherein the activating mechanism comprises a hydraulic cylinder.

14. The improvement as defined in claim 12 wherein the activating mechanism comprises an air cylinder.

15. The improvement as defined in claim 12 wherein the activating mechanism comprises an electric solenoid.

16. The improvement as defined in claim 12 wherein the activating mechanism comprises a human being.

17. A bag filling machine for use in holding a large bag by a plurality of bag loops, the bag having a center and being filled while being held by the machine and then being released from the machine to be transported to a remote location, comprising:

(a) a frame constructed with a pair of arms fixedly attached thereto and a pair of downwardly and inwardly inclined members being downwardly and inwardly inclined toward the center of the bag, the members are fixedly attached to the pair of arms and to the frame, the two pairs of inclined members serving as the holding means;

(b) holding means, associated with the frame, for holding the bag prior to filling the bag and during the filling of the bag;

(c) release means, associated with the holding means, for releasing the filled bag from the holding means after the bag has been filled; the holding means and the release means coacting to permit the filling bag to release itself by gravity from the holding means upon an activation of the release means; and (d) activating means, associated with the release means, for activating the release means at a predetermined time to permit the filled bag to release itself by gravity from the holding means.

* * * * *